US005560709A

United States Patent [19]

Hutchings et al.

[11] Patent Number: 5,560,709

[45] Date of Patent: Oct. 1, 1996

[54] MIXER DRIVE APPARATUS ENABLING RADIAL CHANGING OF SHAFT SEAL

[75] Inventors: William F. Hutchings, Fairport; Marlin D. Schutte, Rochester; Stephen L. Markle, Rochester; Joel S. Berg, Rochester; David J. Engel, Springwater, all of N.Y.

[73] Assignee: General Signal Corporation, Stamford, Conn.

[21] Appl. No.: 555,662

[22] Filed: Nov. 13, 1995

[51] Int. Cl.[6] ..... B01F 7/00

[52] U.S. Cl. ..... 366/331; 177/9; 366/348

[58] Field of Search ..... 366/279, 331, 366/342, 343, 348, 349, 308; 277/9, 11

[56] References Cited

U.S. PATENT DOCUMENTS

| | | | |
|---|---|---|---|
| 2,968,487 | 1/1961 | Glynn . | |
| 3,115,333 | 12/1963 | Lennon | 277/9 |
| 3,280,002 | 10/1966 | Hotter | 277/9 |
| 3,563,516 | 2/1971 | White | 366/279 |
| 3,606,260 | 9/1971 | Rubin | 277/9 |
| 3,887,706 | 4/1975 | Haas et al. . | |
| 4,198,373 | 4/1980 | Kropp et al. . | |
| 4,721,003 | 1/1988 | Hutchings et al. . | |
| 4,795,402 | 1/1989 | Reichardt . | |
| 5,141,392 | 8/1992 | Uvemo . | |
| 5,356,157 | 10/1994 | Houston | 277/9 |
| 5,427,450 | 6/1995 | Gambrill | 366/331 |

*Primary Examiner*—Robert W. Jenkins
*Attorney, Agent, or Firm*—M. Lukacher, Esq.

[57] ABSTRACT

A mixer assembly including a driven hollow quill having first and second conical portions in an axial bore and being adapted to receive and mate with a mixer shaft assembly including a mixer shaft having a conical chamfer to mate with the first conical portion and a quill shaft disposed on and removable from the end of the mixer shaft. The quill shaft has a threaded aperture which cooperates with a jack screw rotatably mounted within the quill bore to draw the conical chamfer into preloaded centered relationship with the first conical portion of the quill bore. A tapered sleeve lodged between the mixer shaft and the second conical portion of the quill bore distributes radial loads on the shaft over a large area of the quill, thereby preventing damage to the shaft and quill. A seal assembly on the mixer shaft isolates the housing from the interior of the vessel. The seal is readily removed for replacement. First, the tapered sleeve is released from the second conical portion. Then the jack screw is rotated to drive the mixer shaft assembly axially from the quill bore. When the mixer shaft is free of the seal assembly, the shaft is secured to the vessel wall. The quill shaft is disconnected from the mixer shaft, and the jack screw is counter-rotated to withdraw the quill shaft from the seal assembly, permitting the seal assembly to be removed in a radial direction from the mixer assembly.

8 Claims, 6 Drawing Sheets

MIXER DRIVE APPARATUS ENABLING RADIAL CHANGING OF SHAFT SEAL

DESCRIPTION

The subject invention relates to apparatus for driving a mixer shaft in a vessel, more particularly to mixer drive apparatus wherein a shaft seal is replaceable, and most particularly to mixer drive apparatus wherein a replaceable shaft seal can be removed in a radial direction from the apparatus.

Drive assemblies for turning a mixer shaft and impeller in a vessel are well known. Typically, a drive assembly comprises a rugged cast housing containing a gear train which transmits torque from an electric motor output shaft to a rotatable quill. The housing is firmly mounted as by bolts to a wall of the vessel in proximity to a port through the wall, and the upper end of the mixer shaft protrudes through the port and is coupled into the rotatable quill. Various proposed assemblies for connecting a mixer drive to a mixer shaft are disclosed in U.S. Pat. No. 2,968,487 issued Jan. 17, 1961 to Glynn; U.S. Pat. No. 4,721,003 issued Jan. 26, 1988 to Hutchings et al.; U.S. Pat. No. 4,795,402 issued Jan. 3, 1989 to Reichardt; and U.S. Pat. No. 5,141,392 issued Aug. 25, 1992 to Uvemo.

In a typical drive assembly, a mechanical lip or face seal is employed around the rotatable shaft to prevent material being agitated in the vessel from being splashed into the drive housing. A mechanical seal comprises a stationary member fixed to the housing and a mating rotatable member fixed to the mixer shaft. Seals in general are high-wear components of a mixing system, and they must be replaced relatively frequently. In some known mixers, replacement is a lengthy, cumbersome procedure involving substantial disassembly and reassembly of the drive. Either the quill must be disassembled or the mixer shaft must be axially displaced into the vessel by many inches to permit sliding the seal cartridge off the remaining protruding end of the mixer shaft.

U.S. Pat. No. 3,887,706 issued Apr. 15, 1975 to Haas et al. discloses apparatus and a lengthy method for changing a seal cartridge by first disassembling much of the quill driving apparatus to permit axial removal of the spent cartridge along the mixer shaft and out of the assembly through the quill. This procedure is time-consuming, and seal cartridges are limited in diameter to the inner diameter of the quill.

U.S. Pat. No. 4,198,373 issued Apr. 15, 1980 to Kropp et al. discloses apparatus and method to permit radial removal of a seal cartridge by tilting and then rolling the drive motor and transmission to one side. This limits the range of couplings permissible by such a design, and maneuvering the motor and transmission can be difficult and hazardous in large installations.

It is a principal object of the invention to provide improved mixer drive apparatus wherein a mixer shaft seal can be quickly and safely replaced.

It is a further object of the invention to provide improved mixer drive apparatus wherein a mixer shaft seal may be removed from the drive assembly in a radial direction.

It is a still further object of the invention to provide improved mixer drive apparatus wherein a mixer shaft seal may be removed without relocation of the drive motor or transmission and without disassembly of the drive quill.

Briefly described, an improved mixer drive system embodying the invention includes apparatus for easily and rapidly removing a seal cartridge assembly from a drive system. A jack screw mounted in the quill is rotatable in a first direction to load a mixer shaft assembly into the quill for mixing operation. The mixer shaft assembly includes the outer end of the mixer shaft and a hollow quill shaft removably mounted on the end of the mixer shaft. To remove the seal cartridge radially, the jack screw is oppositely-rotated to drive the mixer shaft assembly axially from the quill, displacing the mixer shaft into the vessel and the quill shaft into the seal cartridge. The mixer shaft is attached to the vessel wall, and the quill shaft is separated from the mixer shaft. The jack screw is then rotated in the first direction to withdraw the quill shaft from the seal cartridge, permitting the seal to be removed in a radial direction from the drive housing.

In a mixer drive assembly mounted on a mixing vessel, a hollow quill for coupling a mixer shaft to the drive is disposed conventionally in upper and lower bearings in a housing. The quill has a stepped bore with upper and lower conical portions. The mixer shaft has a conical chamfer at its upper end to mate with the upper conical bore portion to center the shaft in the quill. A tapered sleeve slidable on the shaft is drawn into the lower conical bore portion by bolts to further center the shaft and to provide a large surface area to distribute varying radial loads on the shaft.

A cartridge seal is disposed around the mixer shaft where the shaft enters the vessel. To remove such a seal in a radial direction through the side of the housing of a known mixer drive assembly, for example, to remove thusly the seal 3 shown in FIG. 1 of U.S. Pat. No. 3,877,706, requires that the entire length of shaft protruding through the length of the seal and the length of the quill be displaced axially into the vessel. This displacement may be 18 inches or more. For applications wherein the agitator is already near the bottom of the vessel, such displacement may be impossible. Further, there is no ready means disclosed for controllably effecting such displacement.

We have realized that the protruding mixer shaft need not be a continuous length of rod, but instead may be a shaft assembly formed of two separable shaft components, namely, a mixer shaft and a quill shaft, which can be connected as by bolts or joined by threads to form a continuous functional entity but which can be readily separated to permit radial withdrawal and replacement of the seal after minimal displacement of the mixer shaft component.

The quill shaft is slidably disposed within the quill, is preferably hollow, and is attached to the end of the mixer shaft preferably by a plurality of long binder screws having heads accessible from the upper end of the quill shaft. A removable circular thrust plate is disposed in the quill above the quill shaft. A long jack screw, having a head which bears on the upper surface of the thrust plate, extends through the plate and is threaded through a central bore in the top of the quill shaft. The jack screw thus carries the full weight of the shaft assembly. Rotating the jack screw in a first direction draws the shaft assembly into locking, centering relationship with the upper conical bore portion in the quill.

To change the cartridge seal, first the tapered sleeve in the lower conical bore portion of the quill is released. Then the jack screw is counter-rotated to displace the shaft assembly axially toward the vessel. The distance of displacement need be no more than the axial length of the cartridge. The screw is turned until the mixer shaft is free of the seal and a groove in the mixer shaft can be engaged by a split ring or other retainer to lock the mixer shaft in the vessel opening below the cartridge. The groove is so formed in the shaft that the upper end of the shaft is at or below the lower end of the cartridge seal when the shaft is held by the retainer. The quill shaft is then unbolted from the mixer shaft and is withdrawn from the cartridge by reversing the jack screw in the first direction a sufficient number of turns. Alternatively, the jack screw and quill shaft may be raised directly as by lifting of a ring bolt disposed in the head of the jack screw. The cartridge is then free to be removed and replaced in a radial direction from the housing. Reassembly is the reverse of disassembly.

The foregoing and other objects, features, and advantages of the invention, as well as presently preferred embodiments thereof, will become more apparent from a reading of the following description in connection with the accompanying drawings in which.

Figure 1:
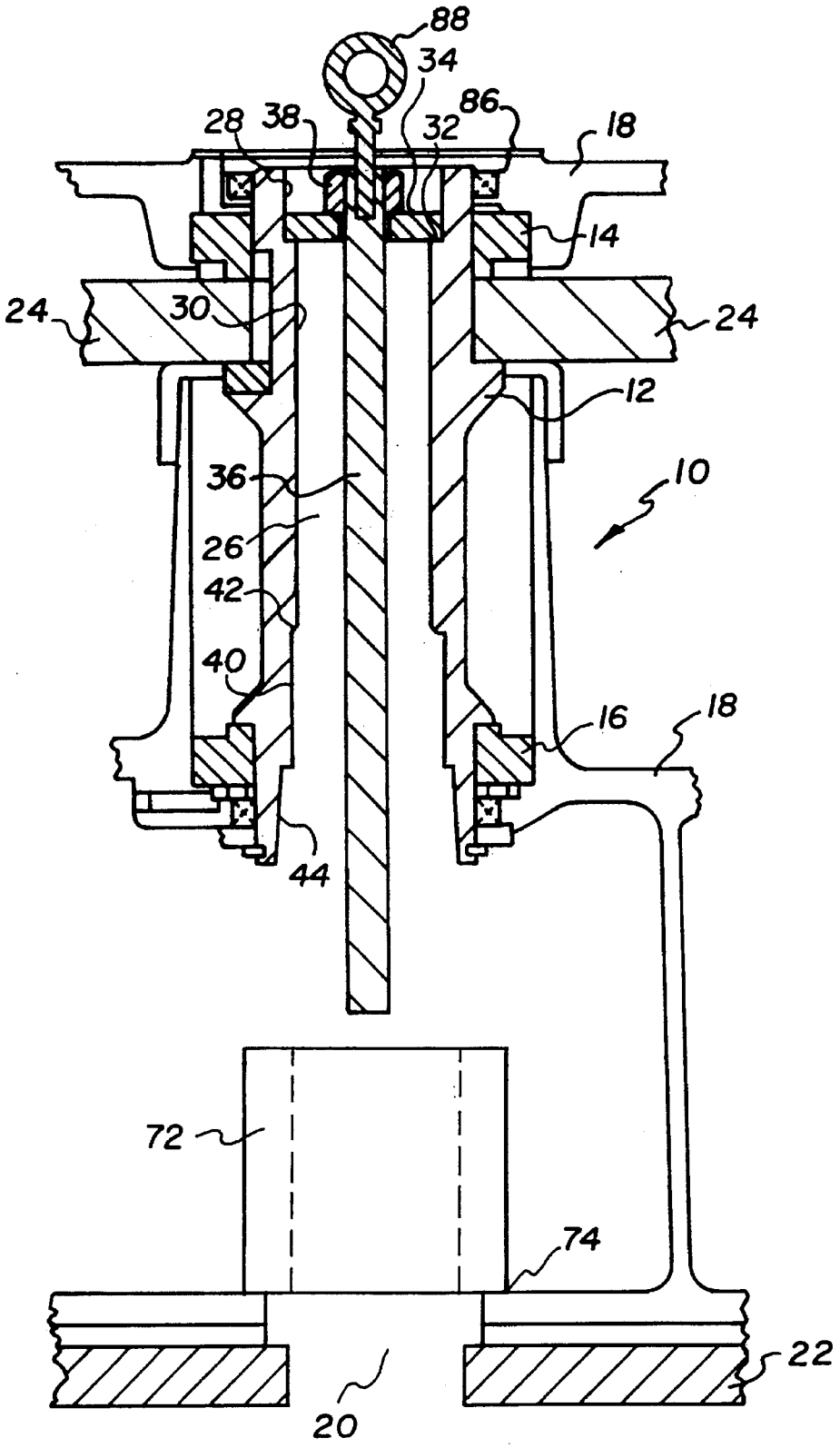
FIG. 1 is a vertical cross-sectional view of a portion of a mixer housing, rotatable quill, jack screw, thrust plate, and cartridge seal in accordance with the invention.
Figure 2:
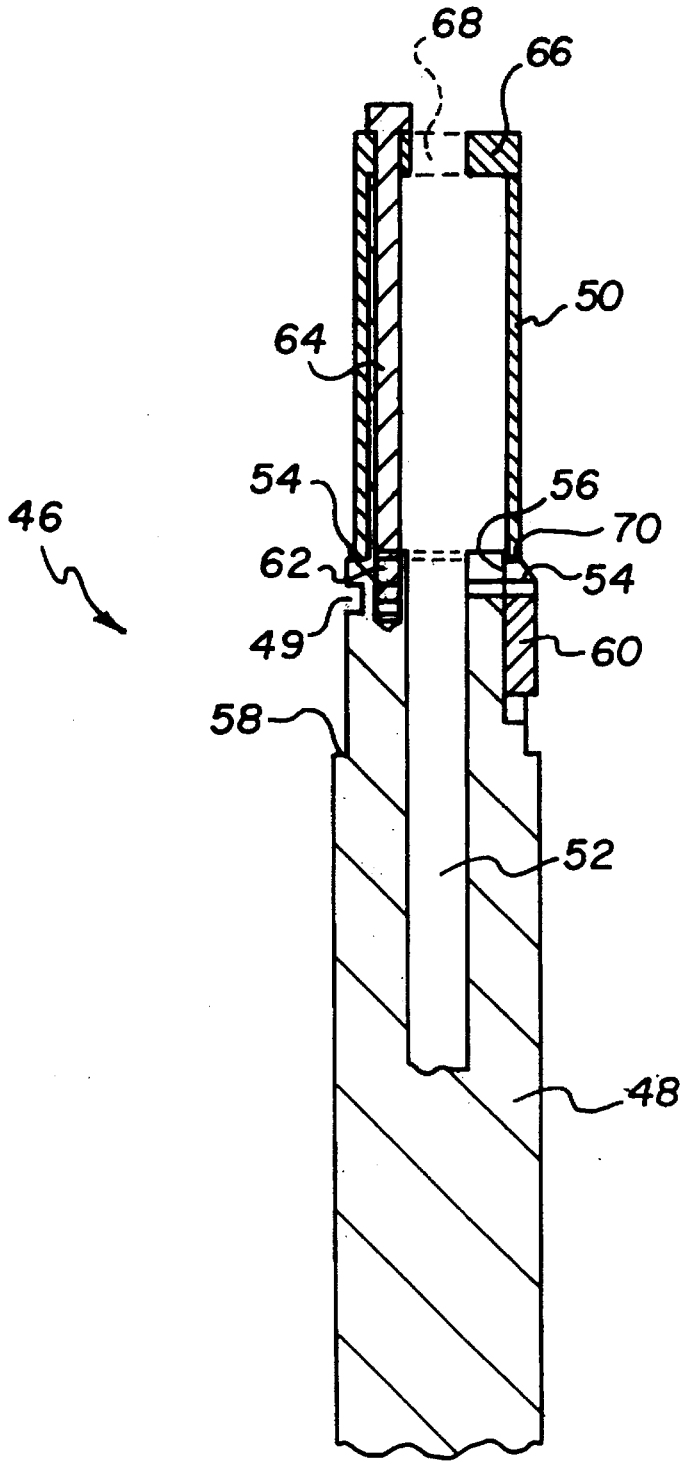
FIG. 2 is a vertical cross-sectional view of a mixer shaft assembly in accordance with the invention.
Figure 3:
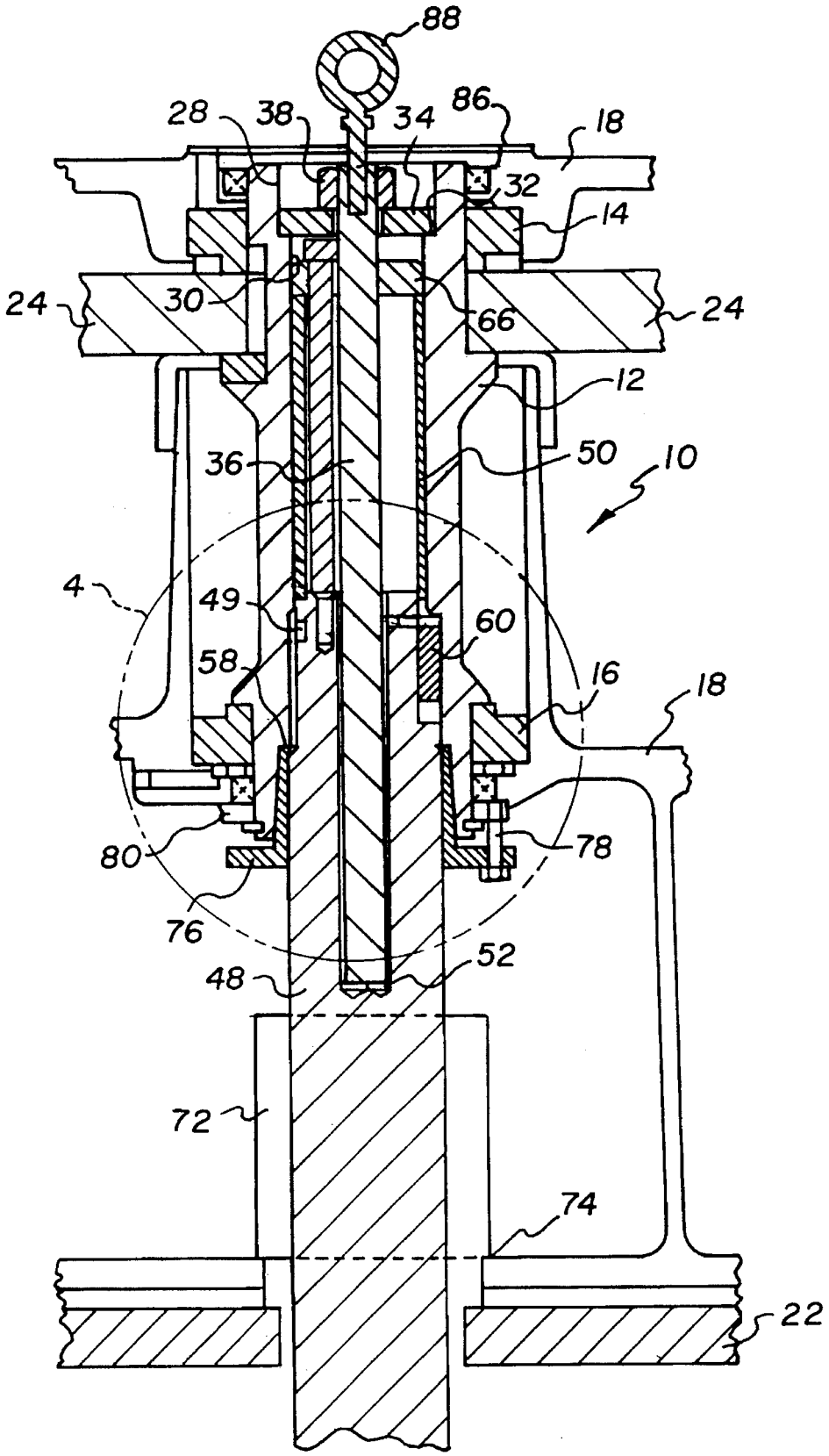
FIG. 3 is a vertical cross-sectional view showing the mixer shaft assembly of FIG. 2 in mating, operational relationship with the quill assembly of FIG. 1.
Figure 5:
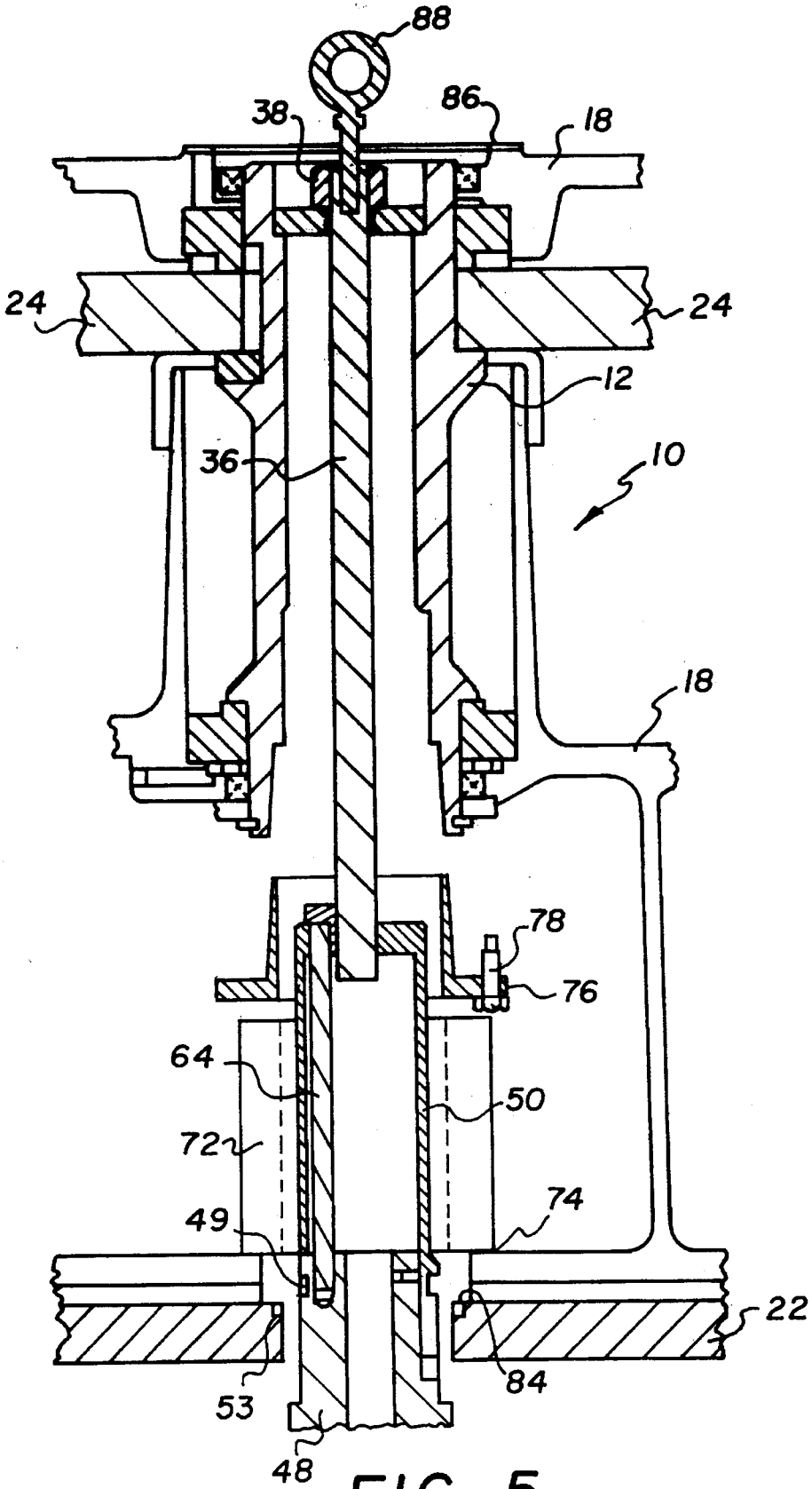
Figure 6:
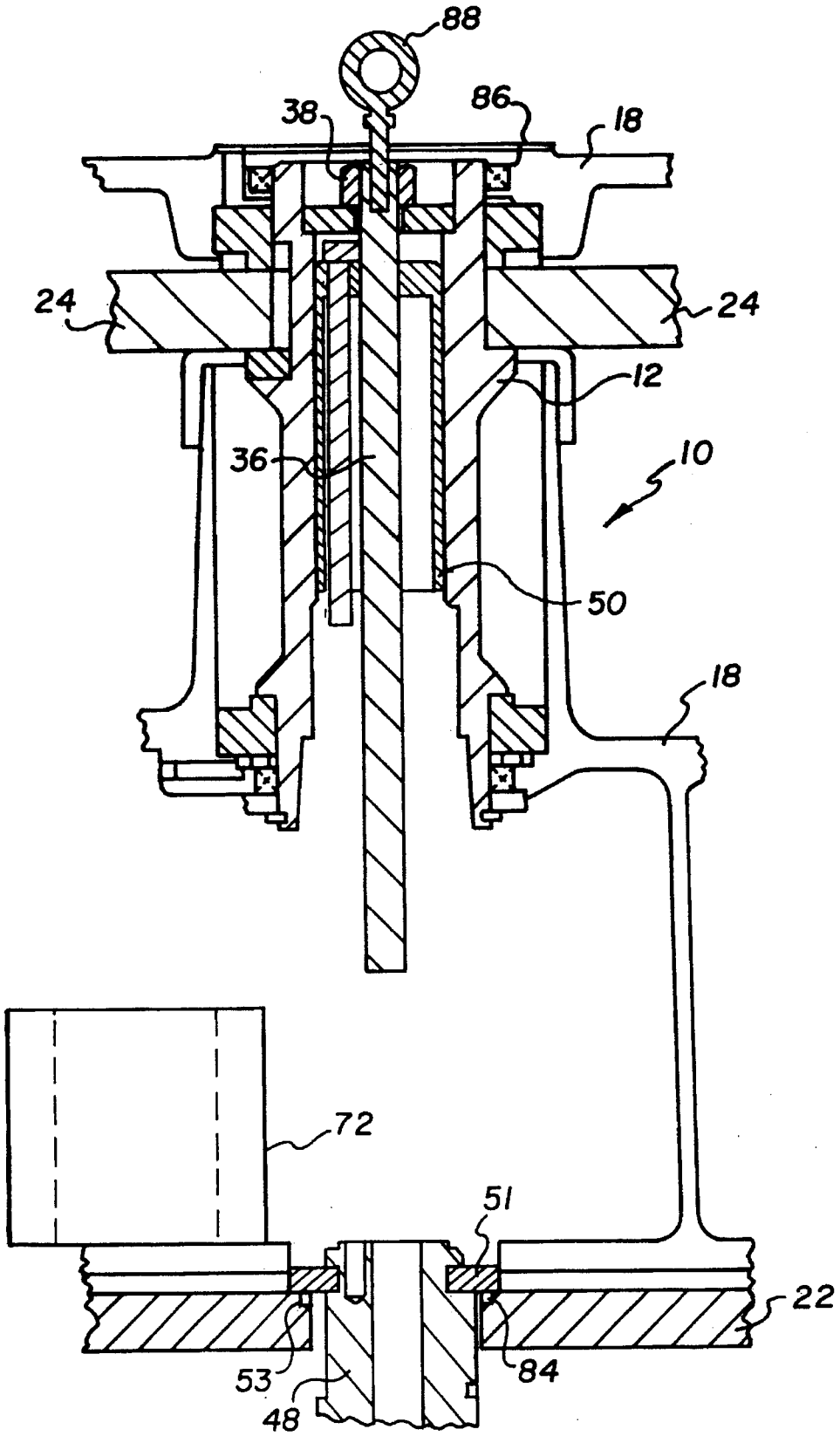

FIG. 5 is a view like that of FIG. 3 showing the mixer shaft assembly having been driven by the jack screw into the vessel in preparation for disassembly; and FIG. 6 is a view succeeding that of FIG. 5 in time, showing the mixer shaft secured by a retainer at the vessel opening, the quill shaft unbolted from the mixer shaft and withdrawn by the jack screw into the quill, and the spent cartridge radially removed from the mixer assembly.

Referring to FIGS. 1 through 4, a drive system 10 has a quill 12 rotatably disposed in upper and lower bearings 14 and 16, respectively, in a housing 18 mountable over an opening 20 in a wall 22 of a mixing vessel. The quill is fixedly mounted in a ring gear 24 adapted to be driven conventionally by a gear train (not shown) connected to a drive motor (not shown) mounted on the housing. The quill has a stepped axial cylindrical bore 26 adapted to receive the upper end of a mixer shaft. The bore has a first diameter 28 in its upper portion and a second, smaller diameter 30 in an adjacent lower portion with a step 32 therebetween. Disposed on the step is a circular thrust plate 34 having a non-threaded central aperture containing a long, fully threaded jack screw 36 having a bolt head 38 above the thrust plate. The jack screw extends beyond the lower end of the quill. The quill bore has a third cylindrical portion larger in diameter 40 than the second portion, and an upper conical portion 42 in transition therebetween. The third cylindrical portion terminates at its lower end in a lower conical portion 44 having a very small included apical angle.

A mixer shaft assembly 46 for turning an impeller at its distal end (not shown) in vessel 22 comprises a mixer shaft 48 and a quill shaft 50. Shaft assembly 46 is adapted to mate and couple with quill 12. Shaft 48 has a central bore or well 52 for storing the lower end of the jack screw without contact. The shaft has a conical chamfer 54 at its proximal end 56 for mating with the first conical section 42 in the quill, which mating serves to center the shaft in the quill. Below the chamfer, the shaft has a diameter slightly less than the diameter of the third portion 40 of the quill, then a step 58 to a larger, working diameter of the mixer shaft. The shaft is keyed 60 conventionally to the inner wall of the quill, and has a plurality of threaded bores 62 in proximal end 56 for receiving a plurality of binder screws 64 to join the quill shaft to the mixer shaft. Alternatively, the quill shaft and mixer shaft may be connected by other means, for example, by being threaded together. Mixer shaft 48 is provided with a detente or annular groove 49 near its proximal end, which groove cooperates with a retainer 51 (FIG. 6) to lock the shaft in the mixer opening during disassembly.

Quill shaft 50 is essentially a removable mixer shaft extension. Preferably, shaft 50 is hollow, being formed for example from tubing, and is closed at its upper end by a pressure plate 66. Plate 66 has a threaded central bore 68 adapted to received jack screw 36, and has a plurality, preferably three, of non-threaded bores disposed preferably symmetrically about bore 68 to receive binder screws Preferably, an annular recess 70 is provided on proximal end 56 inboard of chamfer 54 to seat and to center quill shaft 50 on mixer shaft 48.

A shaft seal 72, for example, a cartridge type mechanical shaft seal assembly, is disposed in housing 18 concentrically with quill bore 26, and is statically sealed against housing 18 at joint 74.

Figure 4:
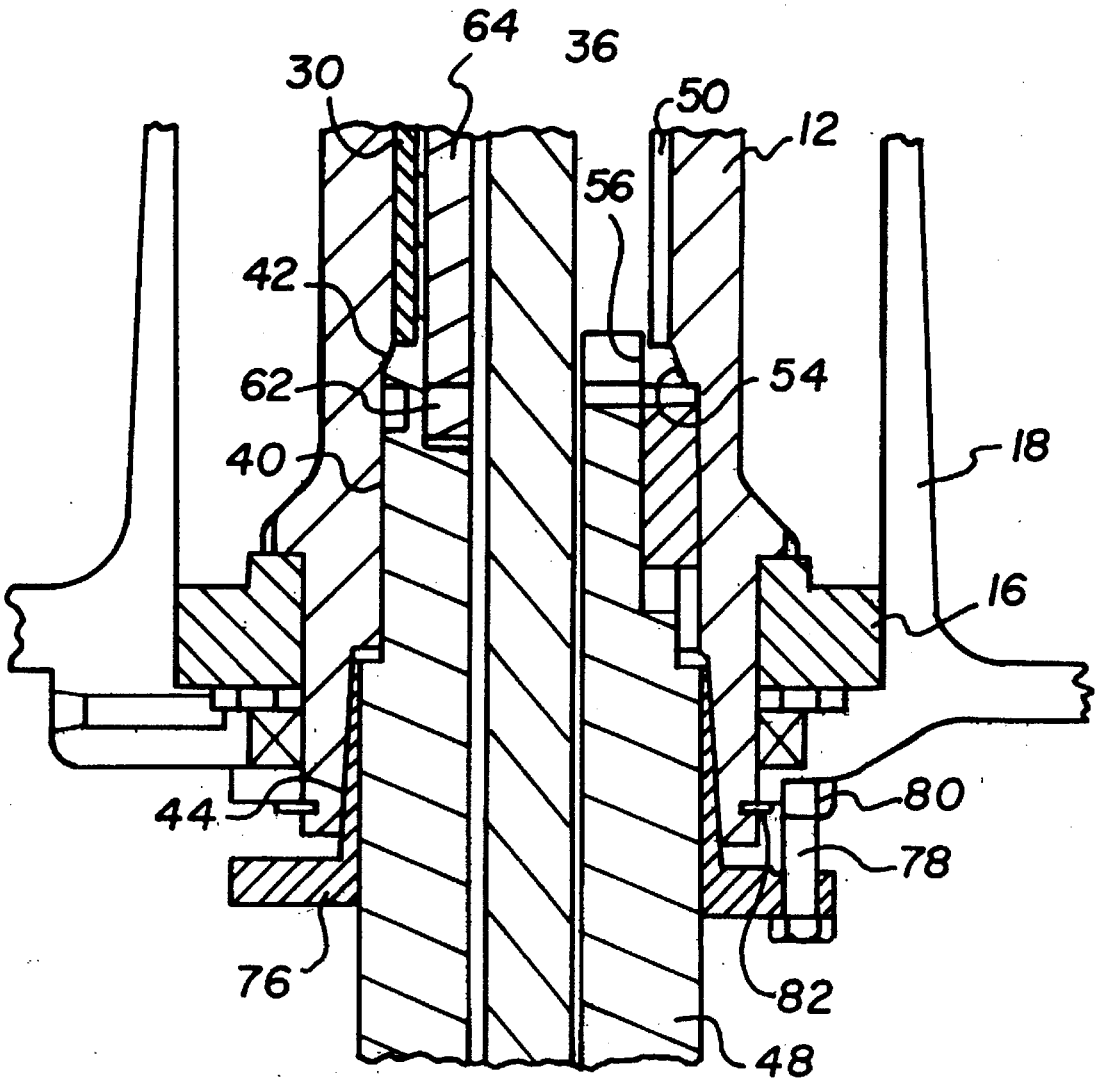
FIG. 4 is a detailed enlargement of the portion of FIG. 3 shown as circle 4, showing the upper and lower tapered locks between the quill and the mixer shaft.

The entire drive assembly comprising shaft assembly 46 inserted into and coupled to drive system 10 is shown in FIG. 3. Jack screw 36 is threaded through quill shaft pressure plate 66 and tightened to draw chamfer 54 into preloaded centering relationship with upper conical portion 42. A tapered sleeve 76 having a cylindrical inner surface and a conical outer surface is slidably disposed on mixer shaft 48 and is seated within lower conical portion 44. Bolts 78 are threaded into thrust ring 80 which is retained on quill 12 by retaining ring 82. Loading of bolts 78 urges the tapered sleeve into the lower conical portion of the quill. The mixer shaft is thus centeringly locked into the quill by a pair of taper locks, as shown in FIG. 4. Tapered sleeve 76 has a relatively large bearing surface against conical portion 44, and thus sudden radial load changes on the shaft during operation of the mixer are distributed over a large area of the shaft and quill. Further, the tapered area is disposed substantially within the lower quill bearing. In some known mixers, these abrupt load changes are not well distributed but instead are concentrated over a short length of the mixer shaft and can lead to bending or breaking of the shaft.

Removal and replacement of the seal assembly is simple and straightforward. With the mixer drive system not operative, the bolts 78 holding tapered sleeve 76 in place are loosened. Jack screw 36 is turned to force mixer shaft assembly 46 out of the quill. Assembly 46 is lowered until annular groove 49 in shaft 48 is clear of the seal assembly, as shown in FIG. 5, at which point retainer 51 is attached to the shaft in groove 49. Assembly 46 is then lowered further until retainer 51 is arrested by retainer seat 84 in housing 18, transferring the weight of the shaft assembly from the jack screw to the retainer. (It may be desirable in some applications to provide a seal under the retainer, for example, an o-ring 53 in an annular groove in seat 84 to prevent escape of fumes from the vessel.) Binder screws 64 are unthreaded from mixer shaft 48, and the jack screw is reversed to separate quill shaft 50 from mixer shaft 48 and lift the quill shaft free of the seal assembly, which can then be easily removed and replaced in a radial direction, as shown in FIG. 6. Alternatively, after the binder screws are unthreaded, cover 86 over quill 12 may be removed, an eye-bolt 88 may be threaded into a tapped bore in head 38, and the jack screw with the quill shaft attached may be lifted clear of the seal assembly or even completely out of the mixer assembly if so desired.

Reassembly is the reverse of disassembly.

From the foregoing description it will be apparent that there has been provided improved mixer drive apparatus whereby a mixer shaft seal may be readily and rapidly serviced or replaced with minimal disassembly of the mixer drive. Variations and modifications of the herein described mixer drive apparatus, in accordance with the invention, will undoubtedly suggest themselves to those skilled in this art. Accordingly, the foregoing description should be taken as illustrative and not in a limiting sense.

What is claimed is:

1. Apparatus for driving a mixer impeller in a vessel, comprising:

a) a housing disposable over a port in a wall of said vessel, said housing supporting a drive motor and containing a transmission operatively connected to said motor;

b) a quill rotatably supported in said housing and operatively connected to said transmission, said quill having an axial bore having first and second conical portions and being adapted to receive therein and mate with a mixer shaft assembly;

c) a mixer shaft assembly having i) a mixer shaft extendable through said port to engage and drive said impeller in said vessel, said shaft having a conical chamfer at an end thereof for mating in centered relationship with said first conical portion in said quill bore, and ii) a quill shaft disposed on and removable from said end of said mixer shaft and having a threaded aperture, the portion of said mixer shaft assembly including said quill shaft being removably disposed within said quill bore;

d) a jack screw rotatably mounted within said quill bore and disposed in threaded relationship in said aperture in said quill shaft, said jack screw being rotatable in a first direction to draw said portion of said mixer shaft assembly into said quill bore and to preload said centered relationship of said conical chamfer in said first conical portion, said preloaded centered relationship defining a first axial position of said mixer shaft assembly; and e) a tapered sleeve slidably disposed on said mixer shaft and lodged between said shaft and said second conical portion of said quill bore to radially support said shaft in said quill.

2. Apparatus in accordance with claim 1 further comprising a seal assembly on said mixer shaft to isolate said housing from the interior of said vessel.

3. Apparatus in accordance with claim 2 wherein said jack screw is rotatable in a second direction counter to said first direction to force said mixer shaft assembly axially from said quill bore.

4. Apparatus in accordance with claim 3 wherein said jack screw is sufficiently rotatable in said second direction to force said mixer shaft out of said seal assembly to a second axial position.

5. Apparatus in accordance with claim 4 further comprising a retainer removably disposable between said mixer shaft and said vessel for holding said mixer shaft in said second axial position.

6. Apparatus in accordance with claim 1 further comprising a thrust plate in said quill bore for supporting said jack screw.

7. Apparatus in accordance with claim 1 wherein said quill shaft is connectable to said mixer shaft by threaded fasteners.

8. A method for removing a shaft seal from a mixer shaft in a mixer assembly having a housing disposable over a port in a wall of a vessel; a quill rotatably supported in the housing and having an axial bore having first and second conical portions and being adapted to receive therein and mate with a mixer shaft assembly comprising i) a mixer shaft having a conical chamfer to mate with said first conical portion and ii) a quill shaft disposed on and removable from the end of the mixer shaft and having a threaded aperture, a portion of the mixer shaft assembly being removably disposed within the quill bore; a jack screw rotatably mounted within the quill bore and disposed in threaded relationship in the aperture in the quill shaft; a tapered sleeve slidably disposed on the mixer shaft and lodged between the shaft and the second conical portion of the quill bore; and a seal assembly on the mixer shaft to isolate the housing from the interior of the vessel, the method comprising the steps of:

a) releasing said tapered sleeve from said second conical portion;

b) rotating said jack screw to drive said mixer shaft assembly axially from said quill bore and said mixer shaft from said seal assembly, said quill shaft being driven thereby into said seal assembly;

c) securing said mixer shaft to said vessel wall;

d) disconnecting said quill shaft from said mixer shaft;

e) counter-rotating said jack screw to withdraw said quill shaft from said seal assembly; and f) withdrawing said seal assembly in a radial direction from said housing.

* * * * *